US011640870B2

(12) United States Patent
Yang et al.

(10) Patent No.: US 11,640,870 B2
(45) Date of Patent: May 2, 2023

(54) COIL COMPONENT

(71) Applicant: SAMSUNG ELECTRO-MECHANICS CO., LTD., Suwon-si (KR)

(72) Inventors: Ju Hwan Yang, Suwon-si (KR); Byung Soo Kang, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 891 days.

(21) Appl. No.: 16/281,810

(22) Filed: Feb. 21, 2019

(65) Prior Publication Data

US 2020/0090853 A1 Mar. 19, 2020

(30) Foreign Application Priority Data

Sep. 14, 2018 (KR) ..... 10-2018-0110409

(51) Int. Cl.

| | |
|---|---|
| ***H01F 27/28*** | (2006.01) |
| ***H01F 27/29*** | (2006.01) |
| ***H01F 41/04*** | (2006.01) |
| ***H01F 41/12*** | (2006.01) |
| ***H01F 27/32*** | (2006.01) |

(52) U.S. Cl.

CPC ..... *H01F 27/2804* (2013.01); *H01F 27/29* (2013.01); *H01F 27/323* (2013.01); *H01F 41/041* (2013.01); *H01F 41/122* (2013.01); *H01F 2027/2809* (2013.01)

(58) Field of Classification Search

USPC ..... 336/192, 198, 200

See application file for complete search history.

(56) References Cited

U.S. PATENT DOCUMENTS

2012/0274432 A1* 11/2012 Jeong ..... H01F 17/0033 336/192
2014/0253277 A1* 9/2014 Takezawa ..... H01F 27/2804 336/200
2015/0102891 A1 4/2015 Yoon et al.

(Continued)

FOREIGN PATENT DOCUMENTS

JP 2007-67214 A 3/2007
KR 10-2015-0114924 A 10/2015
KR 10-2018-0012621 A 2/2018

*Primary Examiner* — Shawki S Ismail
*Assistant Examiner* — Kazi S Hossain
(74) *Attorney, Agent, or Firm* — Morgan, Lewis & Bockius LLP

(57) ABSTRACT

A coil component includes a body having one surface and the other surface opposing each other in a first direction; an internal insulating layer buried in the body; a coil portion disposed in the internal insulating layer, and forming at least one turn centering on an axis in a second direction perpendicular to the first direction; first and second external electrodes disposed on one surface of the body and spaced apart from each other, and connected to the coil portion; an external insulating layer covering the body and exposing the first and second external electrodes. Lengths of the first and second external electrodes taken in the second direction are shorter than a length of the external insulating layer taken in the second direction.

13 Claims, 5 Drawing Sheets

(56) References Cited

U.S. PATENT DOCUMENTS

| | | | | |
|---|---|---|---|---|
| 2016/0141093 | A1* | 5/2016 | Jeong | H01F 17/04 336/200 |
| 2016/0268038 | A1* | 9/2016 | Choi | H01F 27/255 |
| 2017/0103848 | A1* | 4/2017 | Yoneda | H01F 17/0013 |
| 2018/0096778 | A1* | 4/2018 | Yatabe | H01G 4/40 |
| 2019/0189338 | A1* | 6/2019 | Kim | H01F 27/2828 |
| 2019/0362883 | A1* | 11/2019 | Kang | H01F 27/346 |

* cited by examiner

COIL COMPONENT

CROSS-REFERENCE TO RELATED APPLICATION(S)

This application claims the benefit of priority to Korean Patent Application No. 10-2018-0110409 filed on Sep. 14, 2018 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used together with a resistor and a capacitor in electronic devices.

As electronic devices are designed to have higher performance and to be reduced in size, electronic components used in electronic devices have been increased in number and reduced in size.

Accordingly, an inductor has been reduced in size as well. To implement high capacity and to improve a quality factor (Q) while reducing a size of an inductor, it may be necessary to configure a coil to occupy a relatively large area in a small-sized body.

In addition to increasing an area of a coil, it may also be necessary to facilitate a flow of magnetic flux to improve a performance of an inductor such as inductance (L), quality factor (Q), and the like.

SUMMARY

An aspect of the present disclosure is to provide a coil component reduced in size and capable of implementing high capacity by increasing an area occupied by a coil in the same volume.

Another aspect of the present disclosure is to provide a coil component having an improved performance in relation to inductance (L), quality factor (Q), and the like, of the coil component by reducing impacts from a mounting substrate and an external electrode which impede a flow of magnetic flux.

According to an aspect of the present disclosure, a coil component includes a body having one surface and the other surface opposing each other in a first direction; an internal insulating layer buried in the body; a coil portion disposed in the internal insulating layer, and forming at least one turn centering on an axis in a second direction perpendicular to the first direction; first and second external electrodes disposed on one surface of the body and spaced apart from each other, and connected to the coil portion; an external insulating layer covering the body and exposing the first and second external electrodes. Lengths of the first and second external electrodes taken in the second direction are shorter than a length of the external insulating layer taken in the second direction.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
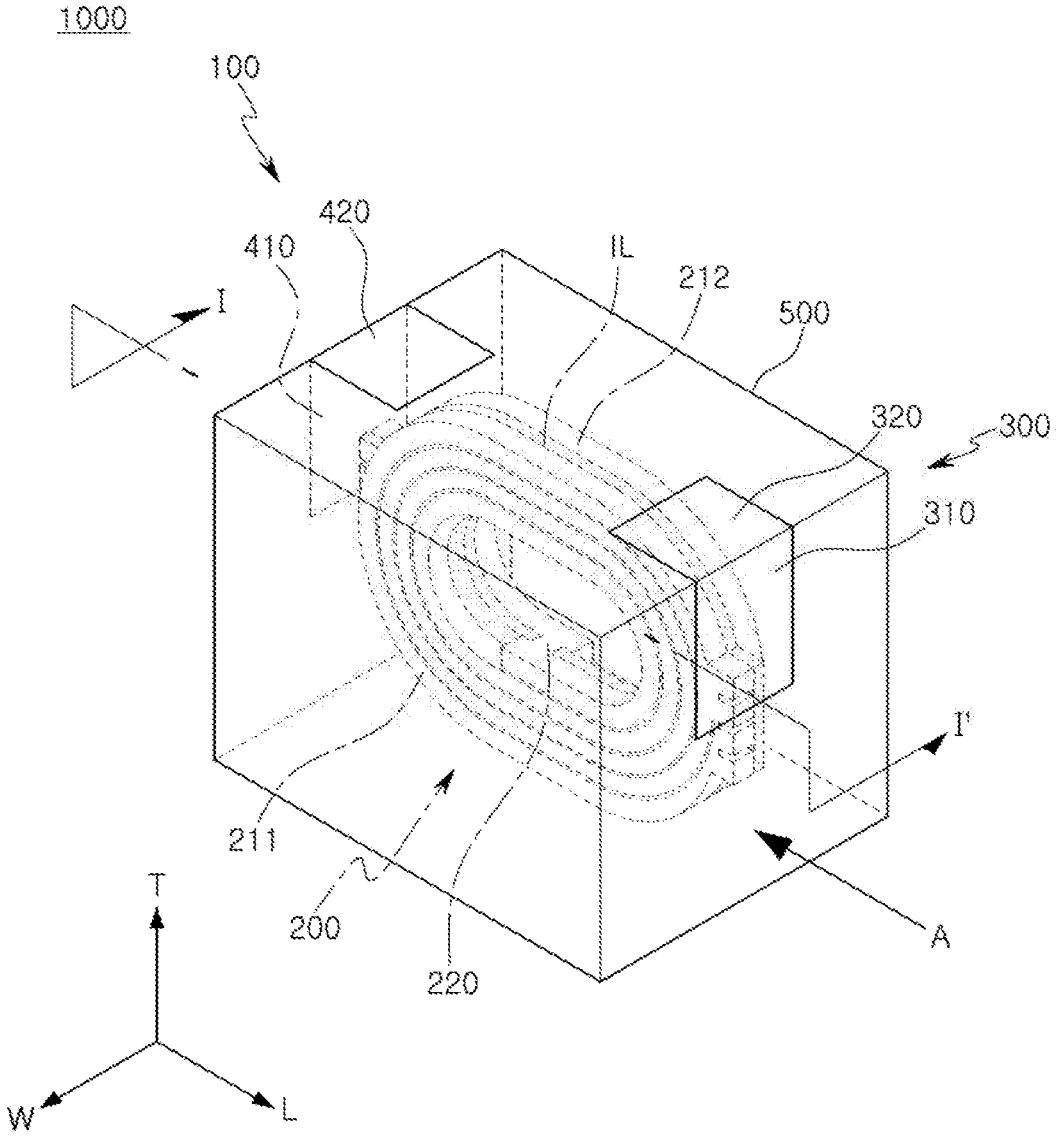
FIG. 1 is a schematic diagram illustrating a coil component according to an exemplary embodiment in the present disclosure.

Hereinafter, embodiments of the present disclosure will be described as follows with reference to the accompanying drawings. The shape and size of constituent elements in the drawings may be exaggerated or reduced for clarity.

The terms used in the exemplary embodiments are used to simply describe an exemplary embodiment, and are not intended to limit the present disclosure. A singular term includes a plural form unless otherwise indicated. The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or below an object, and does not necessarily mean that the element is positioned on the object with reference to a gravity direction.

Herein, a lower side, a lower portion, a lower surface, and the like, are used to refer to a direction toward a mounted surface of the fan-out semiconductor package in relation to cross sections of the drawings, while an upper side, an upper portion, an upper surface, and the like, are used to refer to an opposite direction to the direction. However, these directions are defined for convenience of explanation, and the claims are not particularly limited by the directions defined as described above.

It can be understood that when an element is referred to with "first" and "second", the element is not limited thereby. The terms "first," "second," etc. may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, a T direction is a first direction or a thickness direction, a W direction is a second direction or a width direction, an L direction is a third direction or a length direction.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

In the description below, a coil component according to an exemplary embodiment will be described, and an example in which a coil component is implemented as a power inductor will be described. However, an exemplary embodiment of the coil component is not limited thereto, and coil components other than an inductor may not be excluded from a scope of the exemplary embodiment.

Figure 2:
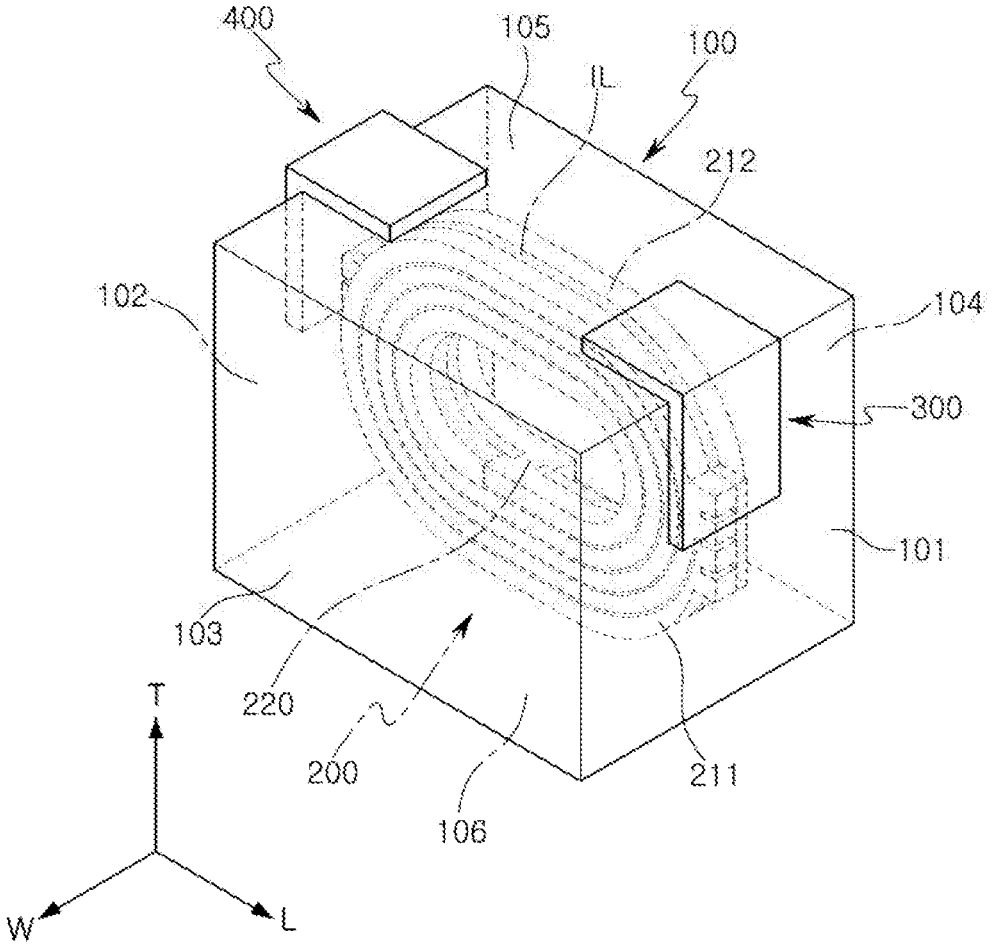
FIG. 2 is a diagram illustrating a coil component in which some of elements illustrated in FIG. 1 are omitted.
Figure 3:
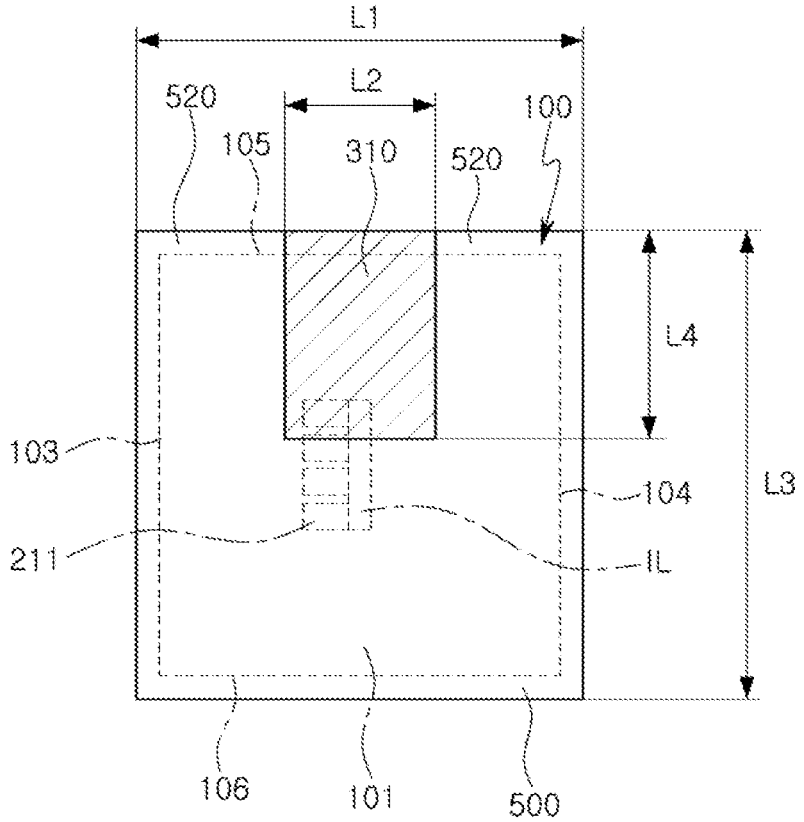
FIG. 3 is a diagram illustrating a coil component, viewing from an A direction according to an exemplary embodiment in the present disclosure.
Figure 4:
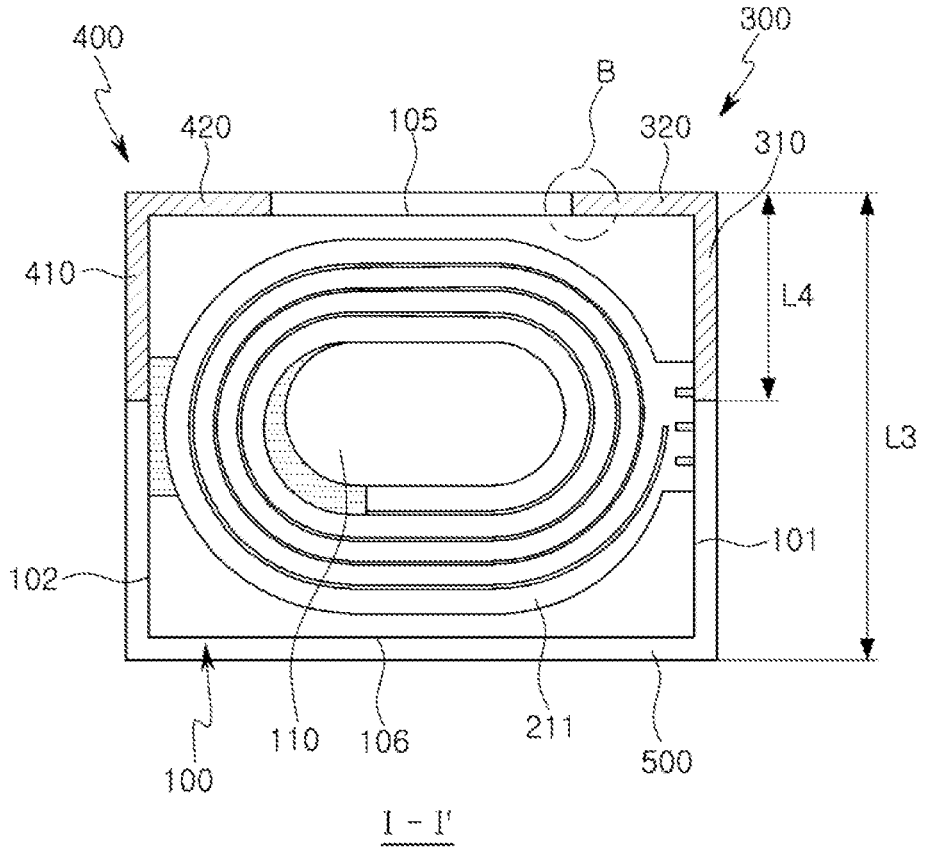
FIG. 4 is a cross-sectional diagram taken along line I-I' in FIG. 1.
Figure 5:
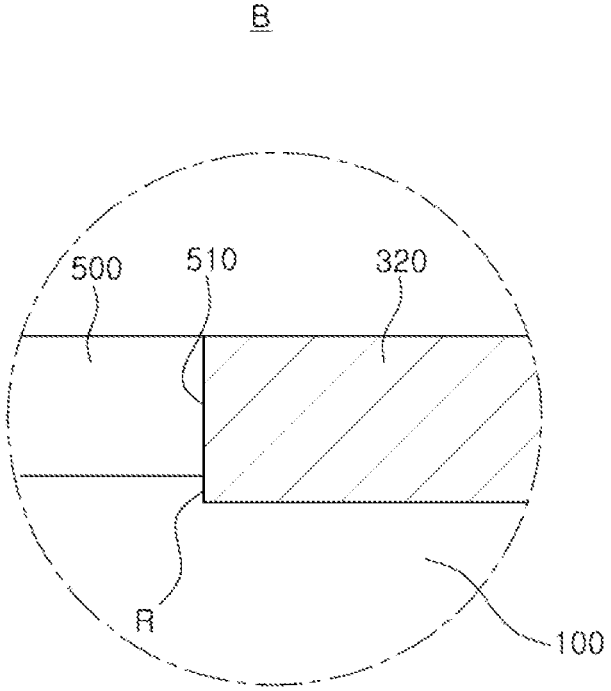
FIG. 5 is a diagram illustrating portion B illustrated in FIG. 4 in magnified form.

FIG. 1 is a schematic diagram illustrating a coil component according to an exemplary embodiment. FIG. 2 is a diagram illustrating a coil component in which some of elements illustrated in FIG. 1 are omitted. FIG. 3 is a diagram illustrating a coil component, viewing from an A direction according to an exemplary embodiment. FIG. 4 is a cross-sectional diagram taken along line I-I' in FIG. 1. FIG. 5 is a diagram illustrating portion B illustrated in FIG. 4 in magnified form.

Referring to FIGS. 1 to 5, a coil component 1000 may include a body 100, an internal insulating layer IL, a coil portion 200, external electrodes 300 and 400, and an external insulating layer 500.

The body 100 may have a hexahedral shape.

Referring to FIGS. 1 to 4, the body 100 may include a first surface 101 and a second surface 102 opposing each other in a length direction L, a third surface 103 and a fourth surface 104 opposing each other in a width direction W, a fifth surface 105 and a sixth surface 106 opposing each other in a thickness direction T. The first to fourth surfaces 101, 102, 103, and 104 of the body 100 may be walls of the body 100 connecting the fifth surface 105 and the sixth surface 106 of the body 100. In the description below, "both front and rear surfaces of the body" may refer to the first surface 101 and the second surface 102, "both side surfaces of the body" may refer to the third surface 103 and the fourth surface 104, and "one surface and the other surface" of the body 100 may refer to the fifth surface 105 and the sixth surface 106 of the body 100.

As an example, the body 100 may be configured such that the coil component 1000 in which the external electrodes 300 and 400 and the external insulating layer 500 are disposed, which will be described later, may have a length of 1.0 mm, a width of 0.6 mm, and a thickness of 0.8 mm, but an exemplary embodiment thereof is not limited thereto.

The body 100 may include a magnetic material and a resin material. For example, the body 110 may be formed by layering one or more magnetic composite sheets including a magnetic material dispersed in a resin.

The magnetic material may be a ferrite or a magnetic metal powder.

The ferrite powder may include, for example, one or more materials among a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more materials selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more materials among a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an example of the magnetic metal powder is not limited thereto.

The ferrite and the magnetic metal powder may have an average diameter of 0.1 μm to 30 μm, but an example of the average diameter is not limited thereto.

The body 100 may include two or more types of magnetic materials dispersed in a resin. The notion that types of the magnetic materials are different may indicate that one of an average diameter, a composition, crystallinity, and a form of one of magnetic materials is different from those of the other magnetic material.

The resin may include one of an epoxy, a polyimide, a liquid crystal polymer, or mixture thereof, but an example of the resin is not limited thereto.

The body 100 may include a core 110 penetrating through a coil portion 200, which will be described later. The core 110 may be formed by filling a through hole of the coil portion 200 with magnetic composite sheets, but an exemplary embodiment thereof is not limited thereto.

The internal insulating layer IL may be buried in the body 100. For example, the internal insulating layer IL may have a planar shape, and the internal insulating layer IL having a planar shape may be buried in the body 100 in a form in which the internal insulating layer IL is substantially parallel to a thickness direction of the body 100. In other words, the internal insulating layer IL may be disposed to substantially be perpendicular to the fifth and sixth surfaces 105 and 106 of the body 100. The internal insulating layer IL may support the coil portion 200. The notion that the internal insulating layer IL having a planar shape is substantially perpendicular to the fifth and sixth surfaces 105 and 106 of the body 100 may indicate that both surfaces of the internal insulating layer IL opposing each other and having the largest area among a plurality of surfaces of the internal insulating layer IL may be disposed to substantially be parallel to the first direction of the body 100 such that the both surfaces of the internal insulating layer IL may substantially and respectively be perpendicular to the fifth and sixth surfaces 105 and 106 of the body 100.

The internal insulating layer IL may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the internal insulating layer IL may be formed of an insulating material such as prepreg, ajinomoto build-up film (ABF), FR-4, a bismaleimide triazine (BT) resin, a photoimageable dielectric (PID), and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of an insulating material including a reinforcing material, the internal insulating layer IL may provide improved stiffness. When the internal insulating layer IL is formed of an insulating material which does not include a glass fiber, the internal insulating layer IL may be desirable to reducing an overall thickness of the coil portion 200. When the internal insulating layer IL is formed of an insulating material including a photosensitive insulating resin, the number of processes for forming the coil portion 200 may be reduced such that manufacturing costs may be reduced, and a fine hole may be processed.

The coil portion 200 may be buried in the body 100, and may embody properties of the coil component. For example, the coil component 1000 may be implemented as a power inductor as described above, and in this case, the coil portion 200 may store electric fields as magnetic fields such that an output voltage may be maintained, thereby stabilizing power of an electronic device.

The coil portion 200 may include a first coil pattern 211, a second coil pattern 212, and a via 220.

The first coil pattern 211, the second coil pattern 212, and the internal insulating layer IL may be layered in order in a thickness direction T of the body 100 such that the first coil pattern 211, the second coil pattern 212, and the internal insulating layer IL may be disposed to substantially be perpendicular to the fifth and sixth surfaces 105 and 106 of the body 100.

The first coil pattern 211 and the second coil pattern 212 each may have a planar spiral shape. For example, the first coil pattern 211 may form at least one turn on one surface of the internal insulating layer IL centering on an axis in a thickness direction T of the body 100.

The via 220 may penetrate through the internal insulating layer IL to electrically connect the first coil pattern 211 and the second coil pattern 212, and may be in contact with the first coil pattern 211 and the second coil pattern 212.

Accordingly, the coil portion 200 in the exemplary embodiment may be formed as a single coil generating a magnetic field in a width direction W of the body 100. The notion that the coil portion 200 generates a magnetic field in a width direction W of the body 100 may indicate that a direction of a magnetic field in a core portion 110 may substantially be parallel to a width direction W of the body 100.

At least one of the first coil pattern 211, the second coil pattern 212, and the via 220 may include at least one or more of conductive layers.

For example, when the second coil pattern 212 and the via 220 are formed through a plating process, the second coil pattern 212 and the via 220 each may have a seed layer such as an electroless plating layer, and an electroplating layer. The electroless plating layer may have a single-layer structure, or may have a multiple-layer structure. The electroplating layer having a multiple-layer structure may have a conformal film structure in which one of the electroplating layers is covered by the other electroplating layer, or may have a form in which one of the electroplating layers is disposed on one surface of the other plating layers. The seed layer of the second coil pattern 212, and the seed layer of the via 220 may be integrated with each other such that no boundary may be formed between the seed layers, but an exemplary embodiment thereof is not limited thereto. Also, an electroplating layer of the second coil pattern 212 and an electroplating layer of the via 220 may be integrated with each other such that no boundary may be formed between the electroplating layers, but an exemplary embodiment thereof is not limited thereto.

As another example, when the coil portion 200 is formed by, after forming the first coil pattern 211 and the second coil pattern 212 individually, layering the first coil pattern 211 and the second coil pattern 212, the via 220 may include a metal layer having a high melting point, and a metal layer having a low melting point relatively lower than the melting point of the metal layer having a high melting point. The metal layer having a low melting point may be formed of a solder including lead (Pb) and/or tin (Sn). The metal layer having a low melting point may have at least a portion melted due to pressure and temperature generating during the layering process, and an inter-metallic compound layer (IMC layer) may be formed between the metal layer having a low melting point and the second coil pattern 212, for example.

As an example, the first coil pattern 211 and the second coil pattern 212 may be formed on and protrude from the internal insulating layer IL. As another example, the first coil pattern 211 may be buried in one surface of the internal insulating layer IL, and one surface of the first coil pattern 211 may be exposed to one surface of the internal insulating layer IL, and the second coil pattern 212 may be formed on and protrude from the other surface of the internal insulating layer IL. In this case, a concave portion may be formed on one surface of the first coil pattern 211, and one surface of the internal insulating layer IL and one surface of the first coil pattern 211 may not be coplanar with each other. As another example, the first coil pattern 211 may be buried in one surface of the internal insulating layer IL, and one surface of the first coil pattern 211 may be exposed to one surface of the internal insulating layer IL, and the second coil pattern 212 may be buried in the other surface of the internal insulating layer IL, and the other surface of the second coil pattern 212 may be exposed to the other surface of the internal insulating layer IL.

Ends of the first coil pattern 211 and the second coil pattern 212 may be exposed respectively to the first surface 101 and the second surface 102 of the body 100. The first coil pattern 211 may be electrically connected to the first external electrode 300, which will be described later, as the end exposed to the first surface of the body 100 is in contact with the first external electrode 300. The second coil pattern 212 may be electrically to the second external electrode 400, which will be described later, as the end exposed to the second surface of the body 100 is in contact with the second external electrode 400.

The first coil pattern 211, the second coil pattern 212, and the via 220 each may include a conductive material such as copper (Cu), aluminum (Al), silver (Ag), tin (Sn), gold (Au), nickel (Ni), lead (Pb), titanium (Ti), or alloys thereof, but an example of the material is not limited thereto.

Although not illustrated, at least one of the first coil pattern 211 and the second coil pattern 212 may be formed as a plurality of coil patterns. For example, the coil portion 200 may have a structure in which a plurality of the first coil patterns 211 are formed, and one of the first coil patterns 211 is formed on one surface of the other first coil pattern 211. In this case, an additional insulating layer may be disposed between the plurality of first coil patterns 211.

The external electrodes 300 and 400 may be disposed on one surface of the body 100, and may be connected to the coil portion 200.

The external electrodes 300 and 400 may include the first external electrode 300 connected to the first coil pattern 211, and the second external electrode 400 connected to the second coil pattern 212. For example, the first external electrode 300 may include a first connection portion 310 disposed on the first surface 101 of the body 100 and being in contact with ends of the first coil pattern 211, and a first extended portion 320 extending from the first connection portion 310 to the fifth surface 105 of the body 100. The second external electrode 400 may include a second connection portion 410 disposed on the second surface 102 of the body 100 and being in contact with ends of the second coil pattern 212, and a second extended portion 420 extending from the second connection portion 410 to the fifth surface 105 of the body 100. The first extended portion 320 and the second extended portion 420 disposed on the fifth surface 105 of the body 100 may be spaced apart from each other such that the first external electrode 300 and the second external electrode 400 may not be directly in contact with each other.

The external electrodes 300 and 400 may electrically connect the coil component 1000 to a printed circuit board, and the like, when the coil component 1000 is mounted on the printed circuit board, and the like. As an example, the coil component 1000 in the exemplary embodiment may be mounted such that the fifth surface 105 of the body 100 faces an upper surface of a printed circuit board, and the extended portions 320 and 420 of the external electrodes 300 and 400 disposed on the fifth surface of the body 100 may be electrically connected to a connecting portion of the printed circuit board.

The external electrodes 300 and 400 may include at least one of a conductive resin layer and an electroplating layer. The conductive resin layer may be formed through a printing process, and may include a thermosetting resin, and one or more of conductive metals selected from a group consisting of copper (Cu), nickel (Ni), and silver (Ag). The electroplating layer may include one or more materials selected from a group consisting of nickel (Ni), copper (Cu), and tin (Sn).

For example, the external electrodes 300 and 400 in the exemplary embodiment each may include a copper plated layer directly formed on a surface of the body 100 through an electroplating process.

The external insulating layer 500 may cover the body 100, and may expose the first and second external electrodes 300 and 400. In other words, the external insulating layer 500 may cover the first to sixth surfaces 101, 102, 103, 104, 105, and 106 of the body 100, and an exposing portion 510 exposing regions in which the external electrodes 300 and 400 are formed among surfaces of the body 100 may be formed. The exposing portion 510 may expose at least portions of the first and second surfaces 101 and 102 of the body 100 and at least a portion of the fifth surface 105 of the body 100. In other words, the exposing portion 510 may expose regions in which the connection portions 310 and 410 and the extended portions 320 and 420 are formed among surfaces of the body 100.

The external insulating layer 500 may include a thermoplastic resin such as a polystyrene resin, a vinyl acetate resin, a polyester resin, a polyethylene resin, a polypropylene resin, a polyamide resin, a rubber resin, an acrylic resin, and the like, or a thermosetting resin such as a phenolic resin, an epoxy resin, a urethane resin, a melamine resin, an alkyd resin, and the like.

The external insulating layer 500 may be formed by layering a plurality of insulating films on each of the first to sixth surfaces 101, 102, 103, 104, 105, and 106 of the body 100, or by dipping the body 100 in an insulating resin. In the former example above, the external insulating layer 500 may be configured such that boundaries may be formed among the plurality of insulating films, and in the later example above, the external insulating layer 500 may be formed in integrated form without boundaries.

The external insulating layer 500 may have a thickness within a range from 10 nm to 100 μm. When a thickness of the external insulating layer 500 is lower than 10 nm, properties of a coil component such as a Q factor may reduce, and when a thickness of the external insulating layer 500 is greater than 100 μm, an overall length, width, and thickness of the coil component may increase such that it may be difficult to reduce a size of the coil component.

The exposing portion 510 may be formed by, after forming the external insulating layer 500 to cover the first to sixth surfaces 101, 102, 103, 104, 105, and 106 of the body 100, removing a portion of the external insulating layer 500. Alternatively, the exposing portion 510 may be formed by selectively forming the external insulating layer 500 in a region other than regions in which the external electrodes 300 and 400 are formed among the first to sixth surfaces 101, 102, 103, 104, 105, and 106 of the body 100. In the former example above, the exposing portion 510 may be formed by removing a portion of the external insulating layer 500 using a laser, through an etching process, or the like.

When the exposing portion 510 is formed on the external insulating layer 500 using a laser, through an etching process, or the like, a portion of the body 100 may be removed along with the external insulating layer 500. Thus, a recess R may be formed in regions of the body 100 (a region corresponding to the exposing portion 510) in which the external electrodes 300 and 400 are disposed.

The exposing portion 510 may be formed between both ends of the external insulating layer 500 disposed in a width direction of the body 100. In other words, a finish portion 520 of the external insulating layer 500 may be disposed in each of outer portions of both ends of the exposing portion 510 disposed in a width direction W of the body 100. Accordingly, distance L2 between both ends of the external electrodes 300 and 400 opposing each other in a width direction W of the body 100 may be configured to be shorter than distance L1 between both ends of the external insulating layer 500 opposing each other in a width direction W of the body 100, and a finish portion 520 of the external insulating layer 500 may be disposed in outer portions of both side surfaces of the external electrodes 300 and 400 opposing each other in a width direction W of the body 100 such that the both side surfaces of the external electrodes 300 and 400 opposing each other in a width direction W of the body 100 may be covered.

In the exemplary embodiment, the external electrodes 300 and 400 may include the connection portions 310 and 410 and the extended portions 320 and 420, and thus, the finish portion 520 may be disposed on the first and second surfaces 101 and 102 of the body 100 on which the connection portions 310 and 410 are formed, and on the fifth surface 105 of the body 100 on which the extended portions 320 and 420 are formed.

By the finish portion 520, widths of the external electrodes 300 and 400 may be formed to be smaller than a width of the external insulating layer 500, a width of the coil component, and the external electrodes 300 and 400 may be disposed between both ends of the external insulating layer 500 in a width direction. Accordingly, in the coil component 1000 in the exemplary embodiment, the number of a coupling member such as a solder, and the like, may be reduced when the coil component is mounted on a printed circuit board. In other words, an increase of a substantial mounting area of the coil component on a printed circuit board, which should be determined in consideration of spreading of a solder, and the like, rather than a width and a length of the coil component, may be prevented.

Lengths L4 of the connection portions 310 and 410 taken in a first direction may be shorter than a length L3 of the external insulating layer 500 taken in the first direction. When the coil component is mounted, a coupling member such as a solder, and the like, may climb the connection portions 310 and 410 and may extend onto both front and rear surfaces of the body 100. The issue above may be prevented by configuring the lengths L4 of the connection portions 310 and 410 taken in the first direction of the body 100 to be shorter than the length L3 of the external insulating layer 500 taken in the first direction of the body 100.

A ratio between the length L3 of the external insulating layer 500 taken in the first direction and the lengths L4 of the connection portions 310 and 410 taken in the first direction may be greater than 0 and may be 0.5 or less. When the ratio between the length L3 of the external insulating layer 500 taken in the first direction and the lengths L4 of the connection portions 310 and 410 taken in the first direction is greater than 0.5, a volume of a coupling member such as a solder, and the like, extending onto both front and rear surfaces of the body 100 may increase such that a substantial mounting area of the coil component on a printed circuit board may excessively increase greater than a width and a length of the coil component.

Although not illustrated, the coil component 1000 may further include an insulating film formed along surfaces of the first coil pattern 211, the internal insulating layer IL, and the second coil pattern 212. The insulating film may protect and insulate the coil patterns 211 and 212, and may include an insulating material such as a parylene, and the like. An insulating material included in the insulating film may not be limited to any particular material. The insulating film may be formed through a vapor deposition process, and the like, but the method of forming the insulating film is not limited thereto. The insulating film may be formed by layering the insulating films on both surfaces of the internal insulating layer IL on which the first and second coil patterns 211 and 212 are formed.

According to the aforementioned exemplary embodiments, even when a size of the coil component is reduced, high capacity may be implemented.

Further, by significantly reducing impacts from a mounting substrate and an external electrode which impede a flow of magnetic flux of a coil component, a performance of a coil component such as inductance (L), quality factor (Q), and the like, may improve.

While the exemplary embodiments have been shown and described above, it will be apparent to those skilled in the art that modifications and variations could be made without departing from the scope of the present invention as defined by the appended claims.

What is claimed is:

1. A coil component, comprising:

a body having one surface and another surface opposing each other in a first direction;

an internal insulating layer buried in the body;

a coil portion disposed on the internal insulating layer, and forming at least one turn centering on an axis in a second direction perpendicular to the first direction;

first and second external electrodes disposed on one surface of the body and spaced apart from each other, and connected to the coil portion; and an external insulating layer covering the body and exposing the first and second external electrodes, wherein lengths of the first and second external electrodes taken in the second direction are shorter than a length of the external insulating layer taken in the second direction, and wherein the external insulating layer includes finish portions respectively disposed on outer portions of both side surfaces of the first and second external electrodes opposing each other in the second direction.

2. The coil component of claim 1, wherein both ends of the coil portion are exposed to both front and rear surfaces of the body opposing each other in a third direction perpendicular to the first and second directions, and wherein the first and second external electrodes respectively include connection portions disposed on both front and rear surfaces of the body and connected to both ends of the coil portion, and extended portions extending from the connection portions to one surface of the body.

3. The coil component of claim 2, wherein the finish portions are disposed on outer portions of both side portions of the connection portions and the extended portions.

4. The coil component of claim 2, wherein lengths of the connection portions taken in the first direction are shorter than a length of the external insulating layer taken in the first direction.

5. The coil component of claim 4, wherein a ratio between a length of the external insulating layer taken in the first direction and lengths of the connection portions taken in the first direction is greater than 0 and is 0.5 or less.

6. The coil component of claim 1, wherein the body has a recess formed on a surface of the body on which the first and second external electrodes are disposed.

7. A coil component, comprising:

a body having an upper surface and a lower surface opposing each other in one direction, and both front and rear surfaces and both side surfaces respectively connecting the upper surface and the lower surface;

an internal insulating layer buried in the body in the one direction;

first and second coil patterns disposed on surfaces of the internal insulating layer which oppose each other in the one direction, and forming at least one turn on both surfaces of the internal insulating layer;

an external insulating layer surrounding the body;

an exposing portion formed on the external insulating layer and consecutively exposing at least portions of both front and rear surfaces of the body and at least a portion of one surface of the body; and first and second external electrodes formed in the exposing portion, connected to the first and second coil patterns, and each having opposing side surfaces in the one direction being in contact with the external insulating layer.

8. The coil component of claim 7, wherein the first and second external electrodes each include connection portions disposed on both front and rear surfaces of the body and being in contact with and connected to both ends of the first and second coil patterns exposed to both front and rear surfaces of the body, and extended portions extending from the connection portions to one surface of the body, and wherein lengths of the connection portions taken in the one direction are shorter than a length of the external insulating layer taken in the one direction.

9. The coil component of claim 7, wherein the body has a recess formed on one region of the body on which the first and second external electrodes are disposed, the recess being recessed from a surface of the body.

10. A coil component, comprising:

an internal insulating layer having a first surface and a second surface opposing the first surface in a width direction;

a first coil pattern and a second coil pattern disposed respectively in the first and second surfaces of the internal insulating layer;

a body enclosing the internal insulating layer, the first coil pattern and the second coil pattern, the body having first and second surfaces extending in a thickness direction and perpendicular to the first and second surfaces of the internal insulating layer and a fifth surface perpendicular to the first and second surfaces of the internal insulating layer and connecting the first and second surfaces of the body, the first and second coil patterns being exposed respectively to the first and second surfaces of the body;

first and second external electrodes respectively connected to the first and second coil patterns and disposed respectively on the first and fifth surfaces of the body and second and fifth surfaces of the body; and an external insulating layer covering the body and exposing the first and second external electrodes, wherein portions of the first and second external electrodes disposed on the fifth surface of the body are spaced apart from each other, wherein lengths of portions of the first and second external electrodes in the width direction disposed on the first and second surfaces of the body are smaller than a length of the external insulating layer in the width direction disposed on corresponding surfaces of the body, and wherein the external insulating layer includes finish portions respectively covering both side surfaces of the first and second external electrodes opposing each other in the width direction.

11. The coil component of claim 10, further comprising a via penetrating the internal insulating layer and connecting the first and second coil patterns.

12. The coil component of claim 10, wherein the body has a recess formed on a surface of the body on which the first and second external electrodes are disposed.

13. The coil component of claim 10, wherein lengths in the width direction of portions of the first and second external electrodes disposed on the fifth surface of the body are smaller than a length of the external insulating layer disposed on the fifth surface of the body.

* * * * *